US007172503B2

(12) United States Patent
Umeda

(10) Patent No.: US 7,172,503 B2
(45) Date of Patent: Feb. 6, 2007

(54) LOW FORCE COIN DISPENSING APPARATUS

(75) Inventor: Masayoshi Umeda, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 5 days.

(21) Appl. No.: 11/022,201

(22) Filed: Dec. 23, 2004

(65) Prior Publication Data

US 2005/0176359 A1 Aug. 11, 2005

(30) Foreign Application Priority Data

Dec. 25, 2003 (JP) ..... 2003-431378

(51) Int. Cl.
*G07D 1/00* (2006.01)

(52) U.S. Cl. ..... 453/29; 453/54

(58) Field of Classification Search ..... 453/18, 453/29, 30, 32–35, 48, 50–54, 57; 221/66, 221/178, 247, 250, 252, 261, 268, 277, 279, 221/280

See application file for complete search history.

(56) References Cited

U.S. PATENT DOCUMENTS

| | | | | |
|---|---|---|---|---|
| 4,592,377 | A * | 6/1986 | Paulsen et al. | 453/33 |
| 5,810,655 | A | 9/1998 | Suzukawa et al. | |
| 6,352,472 | B1 * | 3/2002 | Tsuchida et al. | 453/50 |
| 2003/0096570 | A1 | 5/2003 | Rasmussen et al. | |

FOREIGN PATENT DOCUMENTS

| | | |
|---|---|---|
| EP | 0 729 119 A2 | 2/1996 |
| WO | 03/049049 | 6/2003 |

* cited by examiner

*Primary Examiner*—Patrick Mackey
*Assistant Examiner*—Mark J. Beauchaine

(57) ABSTRACT

A coin dispensing apparatus for automatically directing coins from a coin escalator includes a coin dispensing unit such as a non-metallic roller that is rotatable about a bearing shaft which can be aligned to minimize forces that can shorten the life of a coin dispensing assembly. A guide unit can operatively move the coin dispensing unit at an acute angle to a centerline of a guiding passageway coin exit. A resilient unit can operatively bias the coin dispensing unit to an initial position for contacting coins attempting to exit a coin exit while permitting movement along a guide length with a major biasing force exerted toward the exiting coin to reduce wear on the guide unit.

14 Claims, 10 Drawing Sheets

LOW FORCE COIN DISPENSING APPARATUS

BACKGROUND OF THE INVENTION

1. Field of the Invention

The present invention relates to a coin dispensing apparatus capable of dispensing a large number of coins at a high rate, and more particularly, to an improvement in extending the operative life and efficiency of the components used for dispensing the coins.

2. Description of the Related Art

A large number of different forms of coin dispensing apparatus are utilized and have been proposed in the prior art. Such coin dispensing apparatus can be inserted within various devices such as gambling machines, ticket dispensers, coin changers, etc. The terminology "coin" as used in this specification includes not only monetary coins, but medallions, tokens and other objects which can be stored in bulk and selectively dispensed.

Frequently coins are stored in a bulk condition and a coin selector can segregate individual coins, for example, by a rotating disc that can remove coins from a hopper and deliver them to a coin escalator that extends perpendicularly upward from the hopper. The coins are dispensed and are controlled in a one-by-one manner from a coin outlet at the upper end of the coin escalator.

An example of such a structure can be found in the Laid-Open Japanese Patent Application No. 08-293051.

The coins that are moved along the coin escalator are pushed by the subsequent coins until they reach a coin exit position. The prior art has positioned a dispensing body generally to move parallel to the centerline of the coin guiding passageway through the escalator. The dispensing body can be resiliently urged to contact the uppermost coin as it exits from the coin exit of the guiding passageway. Use of such a device, for example, in a gambling machine such as a slot machine can have a large number of coins released relative to any jackpot. As such, the dispensing body is repetitively moved with each individual coin exiting the coin exit. The dispensing body is biased by a force such as a spring force which counters the impact force of the coin. This dispensing body frequently is limited in its travel by a stopper.

The expected life of such devices is frequently over one million coins dispensed. Under these conditions, the dispensing body will be subject to numerous impacts and contacts with stoppers. Additionally, the dispensing body when aligned parallel to the centerline will displaced by a greater amount of movement relative to the size or diameter of the dispensed coin.

With the dispensing body moving parallel to the centerline of the guiding passageway of the coin escalator, the spring force must be large enough to accommodate this displacement and any stoppers that are utilized or guiding walls for the dispensing body must be robust enough to withstand resulting impacts of the dispensing body over the life of the system. In such an arrangement, the dispensing body can receive wear and tear as a result of components of spring force and coin forces distributed through the dispensing body on the structure. Additionally, the resulting forces create resistance to movement which can interfere with a smooth operation in the dispensing of the coins.

With reference to FIG. 8, a coin selector unit 10 can include a support frame 12 which can mount a cylindrical hopper or bowl 16 for storing coins. A first rotating disc 18 can be mounting in a slanting manner at the bottom of the bowl 16 to selectively remove coins from the bowl. A second rotating disc 20 can space the coins and deliver them to the coin guiding unit 22 or coin escalator as seen in FIG. 9. In operation the coins in the hopper can fall through the holes 24 in the rotating disc 18 and be supported on a planer surface of the base 26 so that they can be moved by pins or pushing ribs (not shown). These coins are guided in a peripheral direction of the rotating disc 18 by a guide 28 which can separate the coins for delivery to the second rotating disc 20. The second rotating disc 20 includes 5 arms or projections 30 at equal intervals in a star like configuration. The rotating disc 20 will rotate in synchronous with the first rotating disc 18 in an opposite direction of rotation. The projections 30 will receive the coins from the first rotating disc 18 and move them along an arched guiding surface 32.

A coin gate unit 34 includes a roller member that can move along a guiding groove 36 to selectively permit the passage of the coins and prevent the coins from interfering with the second rotating disc 20. A spring 44 can bias the coin against the guiding surface 32. The coin 14 that can pass through the gate unit will be subsequently guided by the curved guiding section 48 shown in FIG. 8 as the lower part of the coin guiding unit 22. The straight guiding section 50 extends perpendicularly upward to permit the coins 14 to rise to the dispensing section 52. The dispensing section 52 is at the top of the coin escalator and can be seen in a detailed manner in FIG. 10 where a pair of guide holes are parallely spaced on either side of a centerline of the coin escalator. A housing or guiding section 52 includes a base 54 and a pair of spacer plates 56 and 58 which can be fixed on the base 54. The thickness of the spacers are slightly thicker than the coins 14 to be dispensed. The spacers 56 and 58 are laterally spaced to be slightly larger than the diameter of the coin 14. A guide member 16 (shown in dotted lines) is located over the base 54 and opposite the respective spacers 56 and 58. The resulting opening forms the coin guiding passageway 64 in a rectangular cross sectional configuration.

Coins 14 are guided along a straight line by the guiding passageway 62 to arrive at the dispensing section 52. Elongated guiding holes 66 and 68 are capable of supporting a coin dispensing body 70 which will control the exiting of the coins 14. A counting sensor unit (not shown) in FIG. 10 can detect the movement of the dispensing body 70 and can be located at the dispensing section 52.

The respective parallel guiding elongated holes 66 and 68 are located on either side of an extension line of the guiding point passageway 62. Thus, guiding elongated hole 66 is located along a left centerline LC relative to the middle centerline CL which is an extension of the axis of the coin guiding passageway. A guiding edge 74 of the spacer is equidistant from the centerline relative to the left centerline LC.

A second guiding elongated hole 68 is located along the right centerline RC which is on the opposite side and symmetrical with respect to the left centerline LC. The respective guiding hole 66 and 68 are connected with a connecting link groove 71.

The dispensing body 70 can be a roller 78 attached to a shaft 76 that is slidable along either of the guiding elongated holes 66 or 68 depending on which direction the coins are to be dispensed. The shaft 76 is urged toward the guiding passageway 62 by an urging means such as a spring.

When coin 14 is dispensed, coin 14 pushes roller 78 against the urging force of urging means. At this time, roller 78 is positioned off to the side of centerline CL of the guiding passageway 62. Therefore, shaft 76 is pushed towards the side surface of the first elongated hole 66 by a component F2 of force F1 which is received from coin 14. The pushing force F2 is bigger, when the shaft 76 is moved further away from guiding passageway 62 as shown by the dotted line. When center CC of coin 14 moves over the line L which connects between the edge section of spacer 58 and the point of contact between roller 78 and coin 14, coin 14 is dispensed by the urging force of the urging means.

Roller 78 has shaft 76 stopped by the end of first guiding elongated hole 66 when it returns to the initial position, afterwards roller 78 stops the next coin 14. Therefore, roller 78 can control the dispensing of coins. When the coin dispensing device is used in a gaming machine, coin 14 is continuously dispensed at a predetermined quantity at relatively high speed. As a result, the total dispensing quantity over an expected service life is over 1 million coins. Therefore, shaft 76 will run to the end of the first elongated hole 66 frequently. As a result, the end of the first elongated hole 66 can suffer a permanent set in fatigue, in other words, a projection can be created which projects towards the side. Therefore, the movement of dispensing body 70 becomes un-smooth and the dispensing of the coins isn't desirable.

For preventing a permanent deformation set, it may be possible to install a hard material at the end of guiding elongated hole 66, however this can be expensive. Also, the large sliding resistance which occurs between shaft 76 and a side surface of the first elongated hole 66 can disturb the smooth movement of dispensing body 70. Therefore, the dispensing of coins becomes undesirable.

In a coin let-off unit, the diameter of coin is changed sometimes. By this, the quantity of the coin which is located at the passageway between the second rotating disk 20 and the dispensing body 70 is also changeable. Therefore, coin dispensing body 70 will have to change its position continuously and may be un-detectable by the sensor. In detail, the length of the straight guiding section 50 is adjusted. As a result, the adjustment can be troublesome. Accordingly, there is a need in this field to improve the performance and endurance of coin dispensing components.

SUMMARY OF THE INVENTION

A first purpose of this invention is to reduce the urging force on the coin dispensing body. A second purpose of this invention is to reduce any fluctuations of the coin urging forces. In other words, the initial velocity is averaged based on the average dispensing force of the coins. A third purpose of this invention is to reduce the energy to dispense the coins. A fourth purpose of this invention is to remove any requirement to adjust the length of the coin guiding unit.

As a solution of these problems, the present invention is structured as follows. A coin dispensing apparatus has a coin let off unit which lets off coins one by one to a guiding passageway by a rotating disk, the let-off coins are guided in a line by the guiding passageway. A dispensing body, which is located at the coin outlet of the guiding passageway and optionally on one side of a centerline of coin guiding passageway, is urged towards the guiding passageway by an elastic body and dispenses coins one by one. The dispensing body is movable along an axis which crosses a coin passage centerline at an acute angle and is positioned away from the centerline.

In this structure, the coins are dispensed to the guiding unit one by one by the let-off unit. In the guiding unit, the coins have contact with a peripheral wall and are aligned, and the rear coins push the front coins. The coins are guided upwards, afterwards the coins are dispensed by the coin dispensing body. In this process, the coin dispensing body is moved along the axis line which is away from the centerline with the guiding passageway by the let-off coins. Accordingly, the distance between the fulcrum of the spring and the dispensing body is drastically shorter than the prior art devices which are moved parallel to the centerline. Therefore, any change in the spring force is smaller. As a result, the urging force on the dispensing body can be set at a smaller and a narrower range. In other words, the stopping section doesn't change shape by wear and tear because the urging force is smaller. Therefore, the movement of the dispensing body can be smooth. As a result, the coins are dispensed smoothly. Also, the components of the guiding section of the dispensing body are smaller than the prior art which is moved parallel to the centerline. Therefore, the dispensing body can move smoothly.

The dispensing body is a roller which is rotatable about a shaft. The shaft is slidable in an elongated guide hole which is located along the axis. In this structure, the dispensing body includes a roller which is supported and is rotatable on a shaft which can move in the elongated hole. Accordingly, the roller has a rolling contact with the coins and the moving friction resistance is smaller. As a result, the coin's dispensing can be smooth.

An end of the elongated hole at a side of the guiding passageway is located on the centerline which is located between the centerline and a side defining member. In this structure, the end section of the elongated hole of the side of the guiding passageway is located on the centerline of the guiding passageway and the guiding passageway defining member. As a result and despite the changing of a coin's diameter, the changing of the dispensing direction can be kept smaller. In other words, different size coins can still be dispensed in a predetermined direction.

The roller is made from resin and is lightweight. Accordingly, the force impact is smaller, because the inertia of the dispensing body is smaller. Therefore, a harder material need not be used and permanent deformation is prevented.

The roller is cylinder like in shape with a base narrower at the top and thicker in the middle. In this structure, the strength of the roller bottom section is larger and the strength of the end side is smaller than the bottom section. In other words, the end of the roller is easy to deform towards the end. Therefore, when the roller receives a pushing force from the coins, the roller is tapered. Accordingly, the coins receive a force towards the side from the roller because of the taper. When the force's direction is towards the base plate, the coins are pushed by the base plate and are moved. Therefore, the moving posture of the coins is steadied and the coins are dispensed with stability.

A sensor unit is located at the coin passageway and directly detects coins in the passageway. In this structure, the coins are dispensed by the roller and are afterward detected by the sensor. The output of the sensor is counted based on the actual dispensed coins. Therefore, the sensor doesn't record erroneous positions of the coins in the coin guiding passageway. As a result, the sensor doesn't make a mistake with the count.

In this structure, when the width of the coin guiding passageway is adjusted for a large coin, the pushed up direction of the dispensing body goes upwards. Therefore, the component of pushing force to the elongated side surface becomes smaller. As a result, the movement of the dispensing body is smooth. Inversely, when the dispensing body is fitted to the smallest coin in the prior art, the component of the pushing force become larger with an increase in the diameter and the moving resistance of the dispensing body became larger. As a result, the coins aren't dispensed smoothly. However in the present invention, the moving resistance becomes smaller. As a result, the movement of the dispensing body becomes smooth. Also, when the dispensing body is located at the second elongated hole, the effect is the same as the first elongated hole.

The roller which is the dispensing body is selectively located at either a first elongated hole or the second elongated hole. When the roller is located at the first elongated hole, it is pushed upwards by the coins and the shaft is guided towards a direction which is away from the centerline by the elongated hole. Also, the change in the spring force is smaller. Therefore, the shock of the shaft by hitting a stopper is smaller. As a result, permanent deformation of the stopper is prevented. Also, the shaft moves away from the centerline. Therefore, the force component which pushes to the side surface of the first elongated hole is smaller, in other words, the roller moves smoothly. Accordingly, the dispensing of the coins can be smooth. Also, the stopper isn't required to use a harder material for preventing the permanent deformation. As a result, it is inexpensive. Also, the first elongated hole and the second elongated hole are connected and the shaft can be moved into either the first elongated hole or the second elongated hole. Therefore, the coins are selectively dispensed towards either the right or the left by only one dispensing body.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
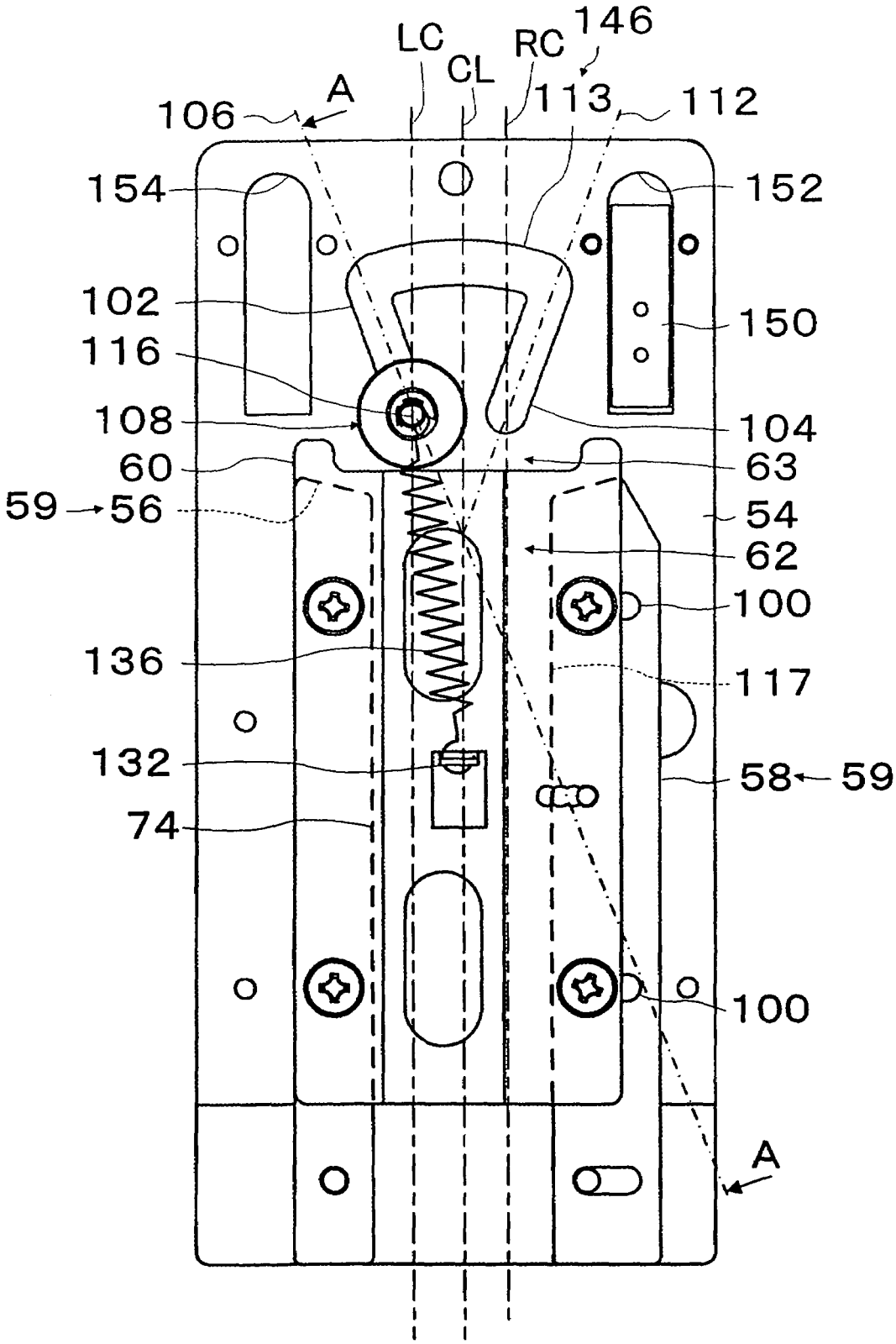
FIG. 1 is a front view of the coin dispensing apparatus of a preferred embodiment of the present invention.
Figure 2:
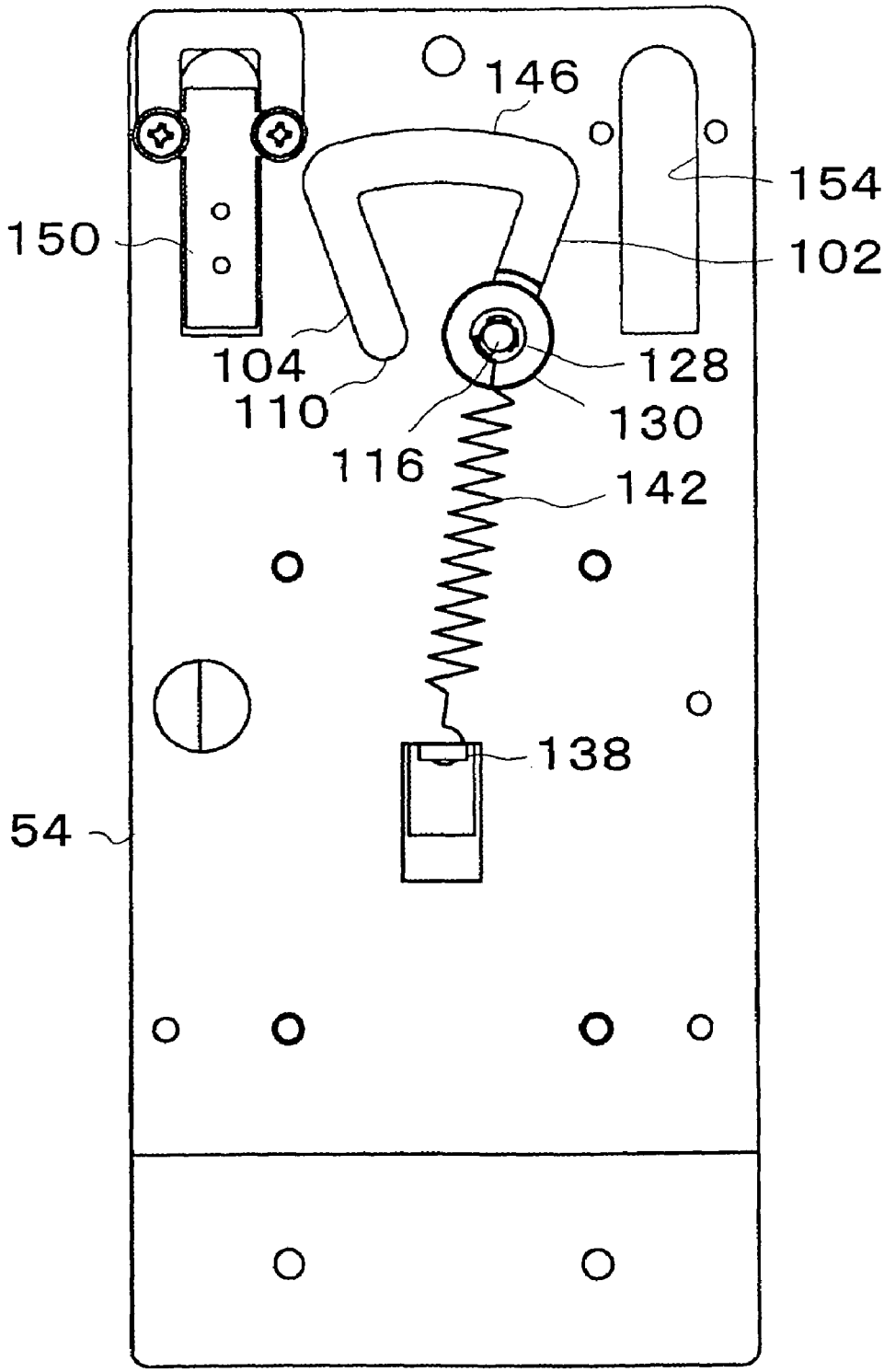
FIG. 2 is a rear view of the coin dispensing apparatus of FIG. 1.

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

In this embodiment, the components which are the same as the above-mentioned prior art are attached with the same reference number, also the different components are explained. Spacer 56 is fixed at base 54 and spacer 58 can be adjusted at the fixed position in parallel to spacer 56 for adapting to the different diameters of coin 14. In other words, spacer 58 can be adjusted in the range of elongated hole 100. The elongated or oblong holes are traverse to the axis of the directions of the coins. Also, spacers 56 and 58 are the side defining members 59 of the coin guiding passageway 62. First elongated hole 102 and second elongated hole 104 are located in base 52 which is located on an extending section of outlet 63 of guiding passageway 62 which is enclosed by base 54, defining members 59 and upper guide plate 60.

As shown in FIG. 1, first elongated guiding hole 102 is located along a first axis line 106 which is straight and slants away from the guiding passageway 62 and centerline CL, positioned in the middle of guiding passageway 62, corresponds to the position of the center part of the maximum diameter coin 14. First elongated hole 102 has a guide function wherein the after-mentioned coin dispensing unit or body 118 is guided obliquely relative to the centerline CL.

First axis 106 is inclined at approximately 20 degrees to the centerline CL. The end section of the first elongated hole 102 on the side of guiding passageway 62 is semicircular. The center of the semicircle is located on centerline LC (for convenience "a left centerline") which is located at the middle between centerline CL and guiding edge 74 of spacer 56. In other words, first elongated hole 102 is located off of centerline CL and it slants at an acute angle. Also, the semicircle section can act as a stopper 110 to after-mentioned shaft 116.

The second elongated hole 104 is symmetrical located to the first elongated hole 102 with respect to an opposite side of the centerline CL. In other words, the second elongated hole 104 is located along a second axis line 112 which inclines at approximately 20 degrees to centerline CL, and it extends straight. The end section of second elongated hole 104 to the side of guiding passageway 62 is semicircular. The center of the semicircle is located on centerline RC (for convenience "a right centerline") which is located at the middle between centerline CL and guiding edge 117 of spacer 58. In other words, second elongated hole 104 is located opposite to the first elongated hole 102 relative to centerline CL and it also slants. Also, the semicircle section functions as a stopper 115. The effect is to provide a guide unit for positioning the coin dispensing unit 108 relative to the guiding passageway coin exit. The guide unit includes a U-shaped opening with respective legs of the U-shaped opening inclined toward each other whereby the coin dispensing unit can be operatively positioned in one of the respective legs to enable movement along an axis that forms an acute angle with the centerline.

The end sections which are located opposite to guiding passageway 62 are connected by a linking connecting passageway 113 whose center interacts the centerline CL, first axis line 106 and second axis line 112 and is arc like in shape and has the same width as the elongated holes 102, 104. By this, first elongated hole 102, a second elongated hole 104 and connecting passageway 113 shape channel shape groove 146 to enable changing the position of dispensing body 108 easily.

Figure 4:
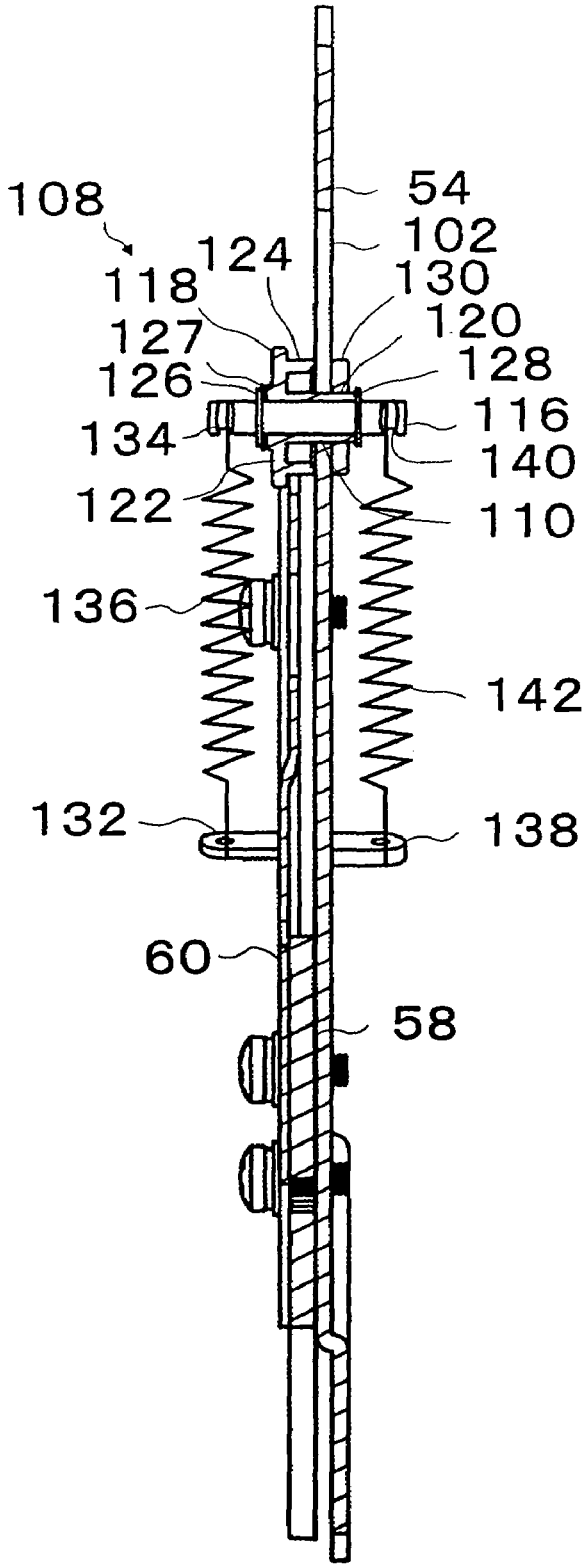
FIG. 4 is a cross section view along A—A line in FIG. 1.

As shown in FIG. 4, shaft 116 is a cylindrical shaft and penetrates first elongated hole 102. Roller 118 which is part of dispensing body 108 is rotatably supported on the middle of shaft 116. Dispensing body 108 has a function of limiting the movement of coins 14. The coins 14 can be dispensed by a smaller force. Therefore, dispensing body 108 can be alternatively changed to a non-rotatable fixed pin, however the roller is more desirable, because the friction resistance with the coins can be reduced. Roller 118 can be from resin and an integrally molded. A resin such as polyacetal is desirable, because it is durable and it resists abrasion.

Roller 118 includes a bearing section 120 which is a cylinder bore with a bottom section 122 which is a disk that protrudes towards the outside from the end of bearing section 120. An outer surface contacting section 124 which is also a cylinder, protrudes to surround the bearing section 120 from the middle of bottom section 122. Bearing section 120 is fitted to shaft 116 and is positioned to the left and right end faces by snap rings 126, 128 which are hooked to shaft 116, and rotatable on the shaft 116. A low friction body 127 which is a ring is located between snap ring 126 and bottom section 122 and is desirable, because roller 118 can rotate more smoothly. Bearing section 120 of dispensing body 108, where shaft 116 is assembled to roller 118, penetrates into the first elongated hole 102. The end face of contacting section 124 has contact with base 54. Retainer 130 can be made from brass and is a ring fitted at bearing section 120 and is held at a predetermined position by snap ring 128. In this component, dispensing body 108 can move in the longitudinal direction of first elongated hole 102.

First elastic body 136 which can be a spring is hooked between first anchor hook section 132 which is bent at a section of guide 60 and a first hooking groove 134, which is located around an end portion of shaft 116. Second elastic body 142 is hooked between second hook section 138 which is bent at a section of base 54 which faces opposite to the first hooking section and a second hooking groove 140 which is located around another end portion of shaft 116. As shown in FIG. 4, first elastic body 136 and second elastic body 142 are the same type of springs and are mounted in parallel.

Dispensing body 108 is moved parallel every time to enable the coins 14 to be dispensed smoothly. In this embodiment, first elastic body 136 and second elastic body 142 are springs, however such elastic bodies can be changed to rubber. In other words, the term elastic body is a generic name which has a function where the extending quantity of its length is in proportion to the resilience forces it produces. Also, when there is at least one elastic body and an appropriate mounting bracket it can also be moved parallel.

Both ends of first elongated hole 102 and the end of second elongated hole 104 are connected with connecting passageway 113 which has an arc shape. The ends of passageway 113 are located at the far ends which is away from guiding passageway 62. Therefore, dispensing body 108 can be selectively located easily at either the first elongated guide hole 102 or the second elongated guide hole 104 through connecting passageway 113. First attaching elongated hole 152 which is attached with a sensor 150 is located parallel to guiding passageway 62 above spacer 58. Second attaching elongated hole 154 which is attached with a sensor 150 is located parallel to guiding passageway 62 above the spacer 56.

Sensor 150 has a function of detecting when coins 14, which were dispensed by dispensing body 108, are detected. Sensor 150 is located at a position which doesn't receive any adverse effect relative to coin outlet 63. In other words, sensor 150 is located at first coin passageway 166 which passes the dispensed coins 14.

Figure 3:
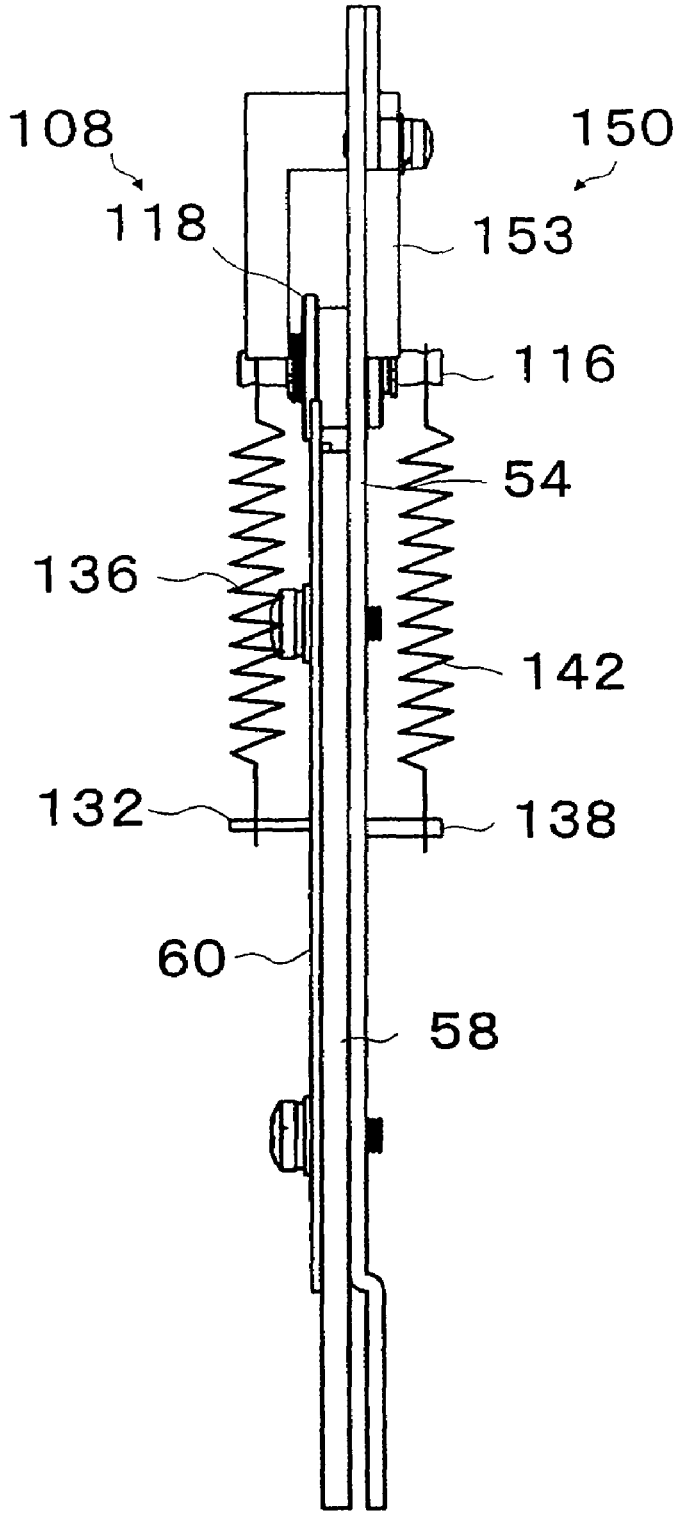
FIG. 3 is a left side view of the embodiment.

Also, a non-contact type sensor for example; a photo-electric or an electric-magnetic sensor can be used for preventing damage such as wear and tear. In this embodiment as shown in FIG. 3, the sensor 150 is a photo-electric type which includes a body 153 of an inverted gate shape, a projecting section which is located at a side of the coin passageway and a receiving section which is located at the other section. The output of sensor 150 is used for counting the dispensed coins 14.

Figure 5:
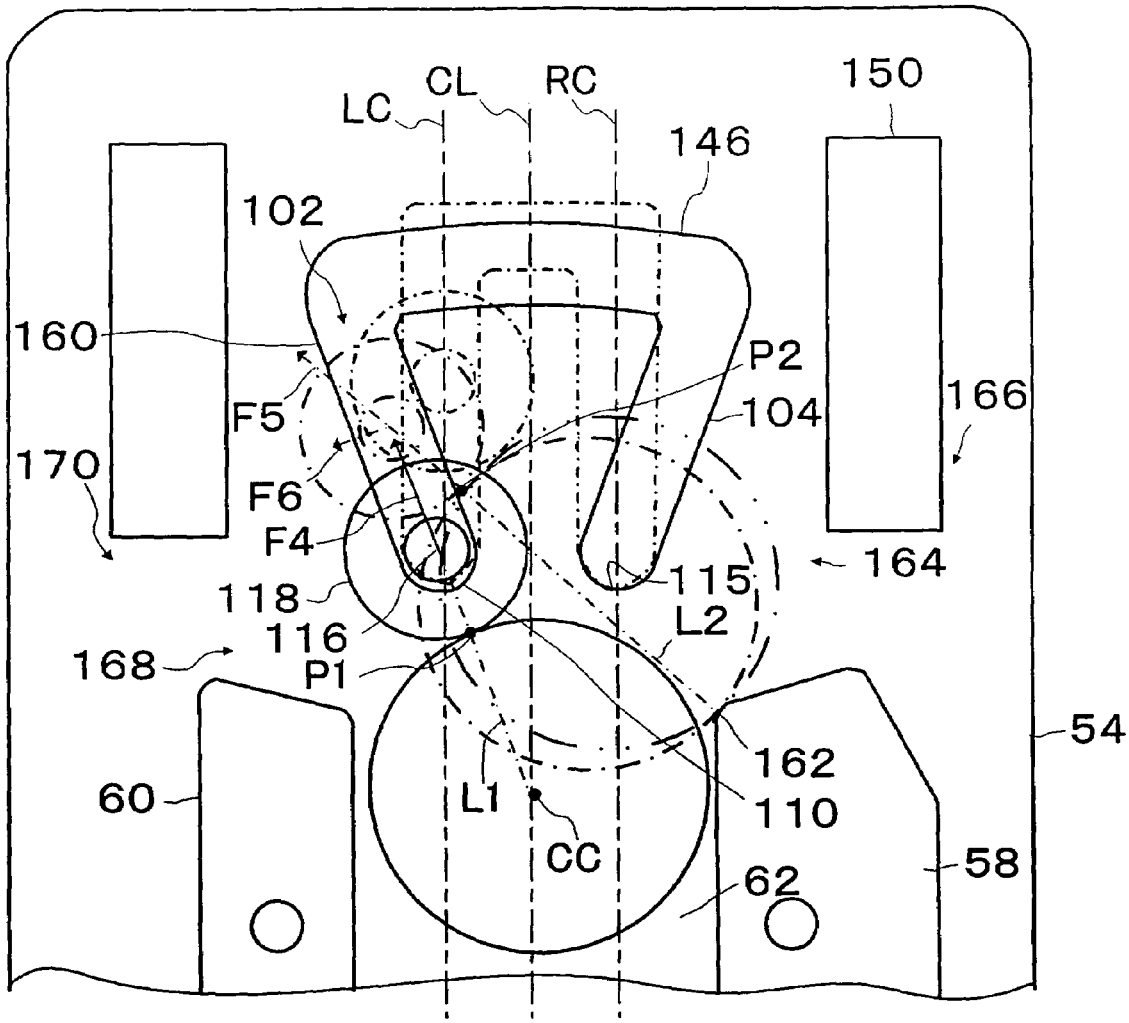
FIG. 5 is a schematic explanatory view of the embodiment.

Next, an operation of this embodiment of the invention is explained. The dispensing body 108 is initially located in first elongated hole 102 as shown in FIG. 5. A coin 14, which is guided by guiding passageway 62, has contact with a contacting section 124 of roller 118 which is part of the dispensing body or unit 108. Next, the coin 14 is moved towards the direction which is away from coin guiding passageway 62 against the combined urging force of both the first elastic body 136 and the second elastic body 142.

Shaft 116 (bearing section 120) is guided by the first elongated hole 102 along a straight line. In other words, shaft 116 is moved away from centerline CL, also it is moved away from guiding passageway 62. When coin 14 has contact with contacting section 124, it is pushed at contacting point P1 by a force F4. The direction of force F4 is located along the axis of the straight line L1 which draws center CC of coin 14 and contacting point P1. Accordingly, the direction is approximately corresponding to the extending direction of first elongated hole 102. Therefore, a component force which is towards the side wall of first elongated hole 102 and which is pushed by bearing section 120 is small and seldom occurs.

Bearing section 120 pushes the outside edge 160 of first elongated hole 102 by a component of the urging force both from the first elastic body 136 and the second elastic body 142. The crossing angle between the force directions both of the first elastic body 136 and the second elastic body 142 and centerline CL is small. Therefore, any force component which is directed towards the outside edge 160 is also small. In other words, when shaft 116 moves in first elongated hole 102, the moving resistance is relatively small. Also, roller 118 has contact with the left side of coin 14 rather than the center CC. Therefore, coin 14 is held by edge section 162 of spacer 58 and roller 118, and it is guided to the right.

As shown by the dotted line in FIG. 5, immediately before coin 14 is dispensed by dispensing body 108, dispensing body 108 receives force F5 through a contacting point P2. Force F5 is located along a straight line L2 which forms a connection between edge 162 of spacer 58 and center CC of coin 14, also the direction slants relative to the axis line 106 of the first elongated guiding hole 102. Therefore, side wall 160 receives the force components which are from the urging forces both of the first elastic body 136 and second elastic body 142 and also the force F5. In other words, when dispensing body 108 goes along the guiding passageway 62, the force component towards the outside edge 160 is bigger in proportion with the distance.

In the prior art, the movement of the dispensing body isn't as smooth, because when coin 14 has contact with a dispensing body at first, the side wall receives a force component from the dispensing body. In the present invention, it seldom occurs that coin 14 has contact with dispensing body 108 with a large force. Therefore, the movement of dispensing body 108 is smooth. Also, dispensing body 108 moves along the extending direction and towards the side of coin 14 as shown in FIG. 5. Particularly, the moving distance towards the side is larger, because first elongated hole 102 slants relative to the centerline CL. Therefore, the extending quantity both of the first elastic body 136 and the second elastic body 142 is smaller than the cited prior art arrangement.

In other words, in the prior art, dispensing body 108, where first guiding elongated hole 66 and roller 78 appear by the dotted lines shown in FIG. 5, is moved to a position which is located at a position which is further from guiding passageway 62. Accordingly, the elastic force both of first elastic body 136 and second elastic body 142 is smaller in the present invention, because the movement quantity of roller 118 is smaller in the present invention. In other words, any impact force where the bearing section 120 impacts into stopper 110 is small. Therefore, the permanent deformation of stopper 110 is prevented. Also, bearing section 120 can be made from resin, therefore it is harder than the metal of base 54, and has elasticity.

Therefore, the impact is reduced by such an elastic function, also the permanent deformation of stopper 110 is prevented. When the coin 14 is dispensed, the dispensing speed of the coin is slower, because the elastic force is smaller. Accordingly, the time where the coin 14 can be detected by the sensor 150 is increased. As a result, detecting mistakes of the coin 14 doesn't occur as frequently.

When center CC of coin 14 passes line L2 which is connected with contacting point P and edge 162, coin 14 is dispensed to a first exit 164 at the right side by the elastic forces both of first elastic body 136 and second elastic body 142. The dispensed coin 14 is dispensed to a predetermined apparatus and passes through first dispensing passageway 166. When coin 14 passes through first dispensing passageway 166, coin 14 crosses the optical axis between the projecting section and the receiving photo section which are first sensor 150. Therefore, first sensor 150 outputs a detecting signal.

In other words, dispensing body 108 and sensor 150 are located separately. When dispensing body 108 is returned by first elastic body 136 and second elastic body 142, dispensing body 108 contacts coin 14, however sensor 150 can detect the passing coin 14. Therefore, the length of the coin passageway which is between second rotating disk 20 and dispensing body 108 doesn't need adjusting.

Figure 6:
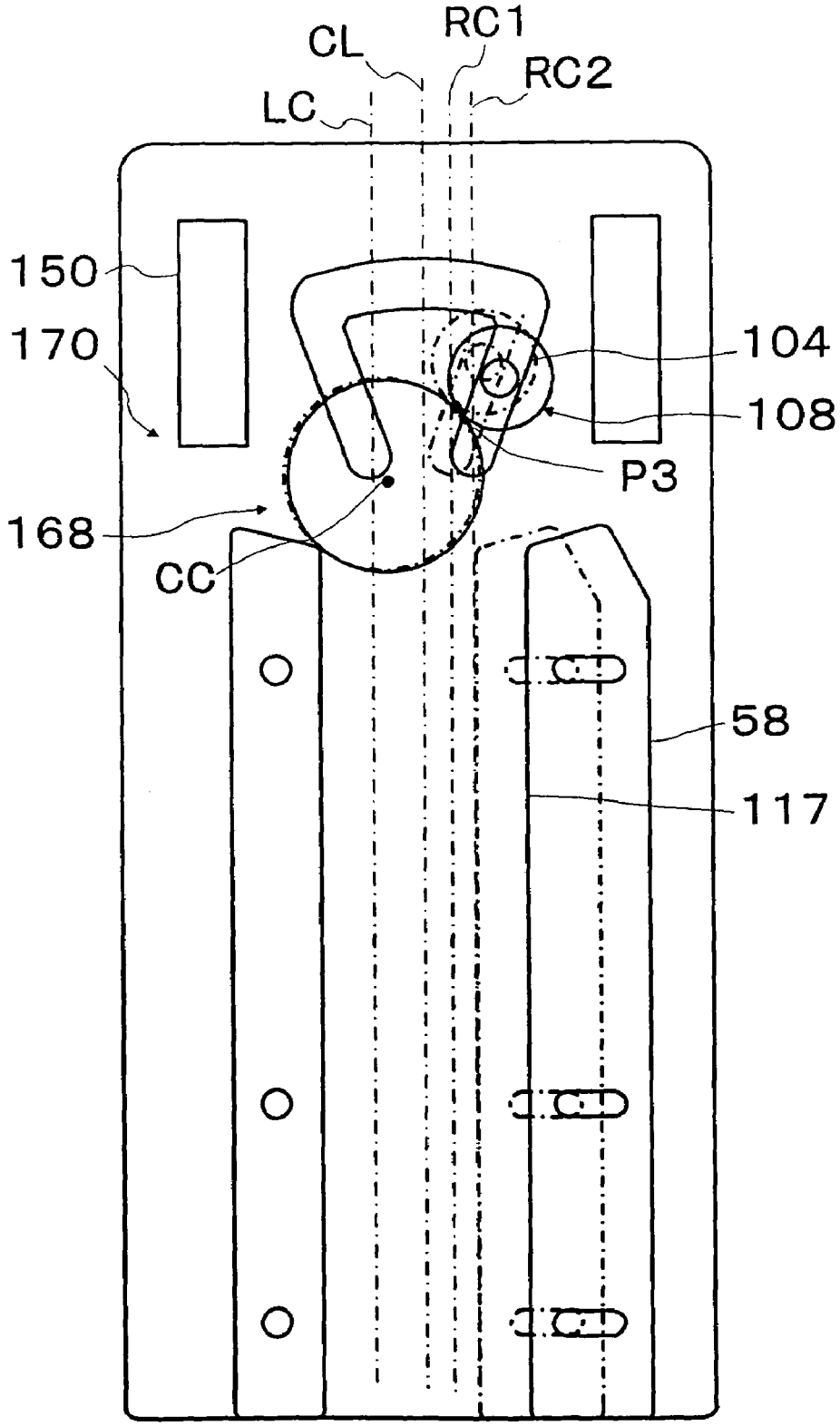
FIG. 6 is a schematic explanatory view of the embodiment.

Next, in another case where dispensing body 108 is located in the second elongated hole 104, is explained by referring to FIG. 6. In this embodiment, a maximum diameter coin 14 is dispensed. Coin 14 is dispensed in the same manner as the above-mentioned case at first elongated hole 102 in principle. In other words, coin 14 has contact with dispensing body 108 at contacting point P3 which is located at the right rather than centerline CL shown in FIG. 6. Therefore, coin 14 is guided to the left, afterwards coin 14 is dispensed from second dispensing slot 168 and goes out through second passageway 170. When coin 14 passes through second passageway 170, it is detected by sensor 150.

Figure 7:
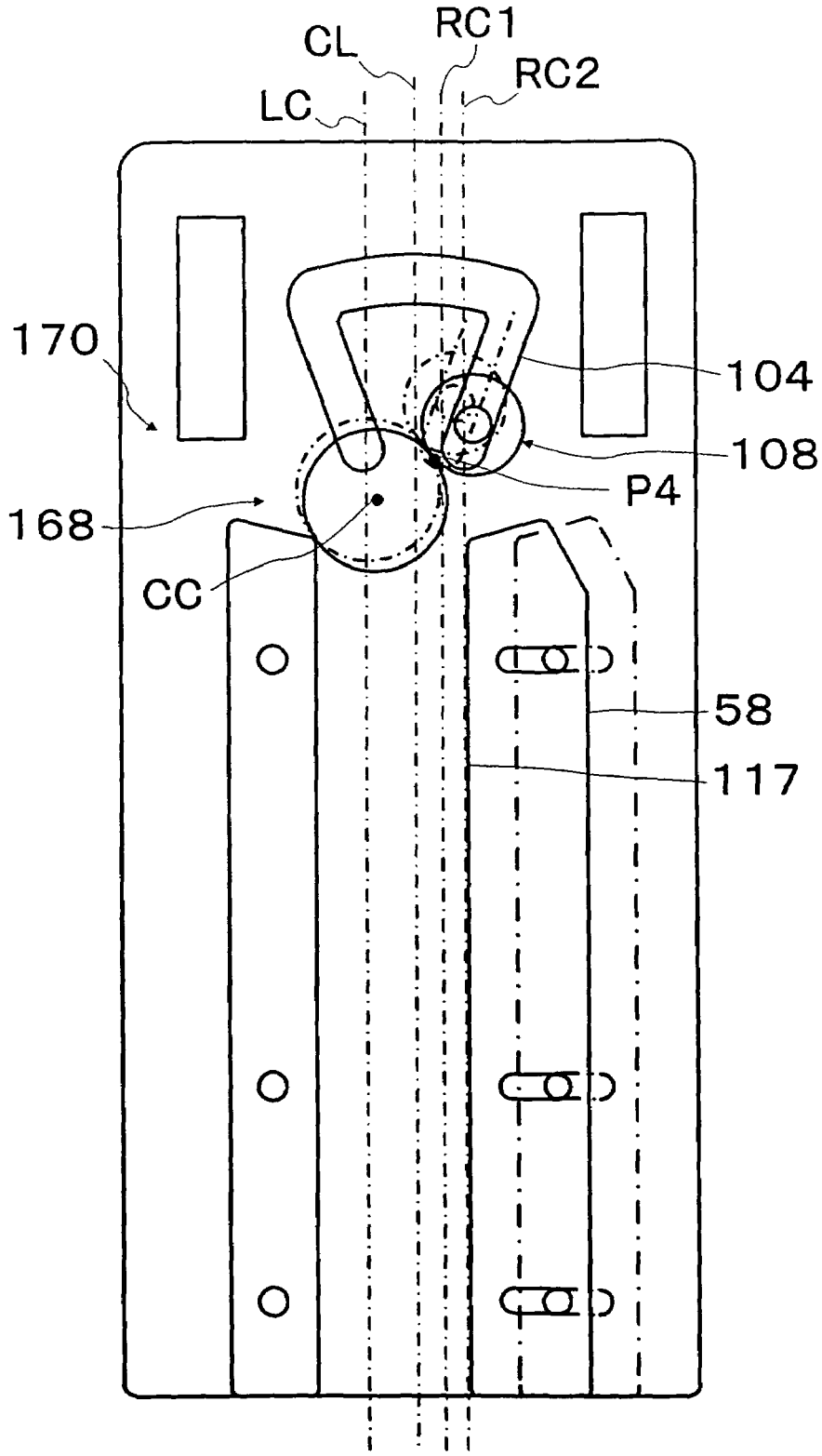
FIG. 7 is another explanatory view of the embodiment.
Figure 8:
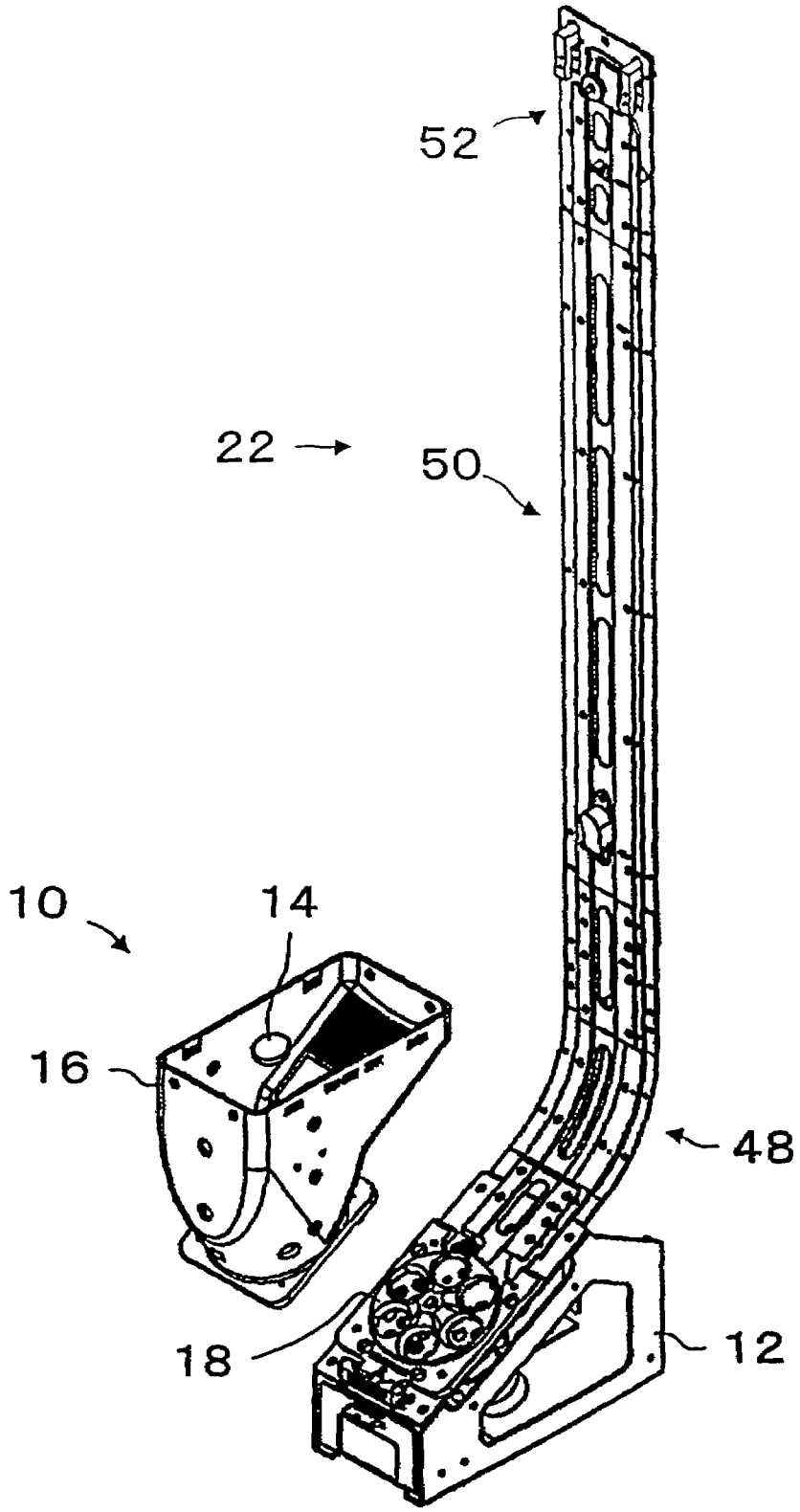
Fig.8 PRIOR ART
FIG. 8 is an exploded view of a coin dispenser.
Figure 9:
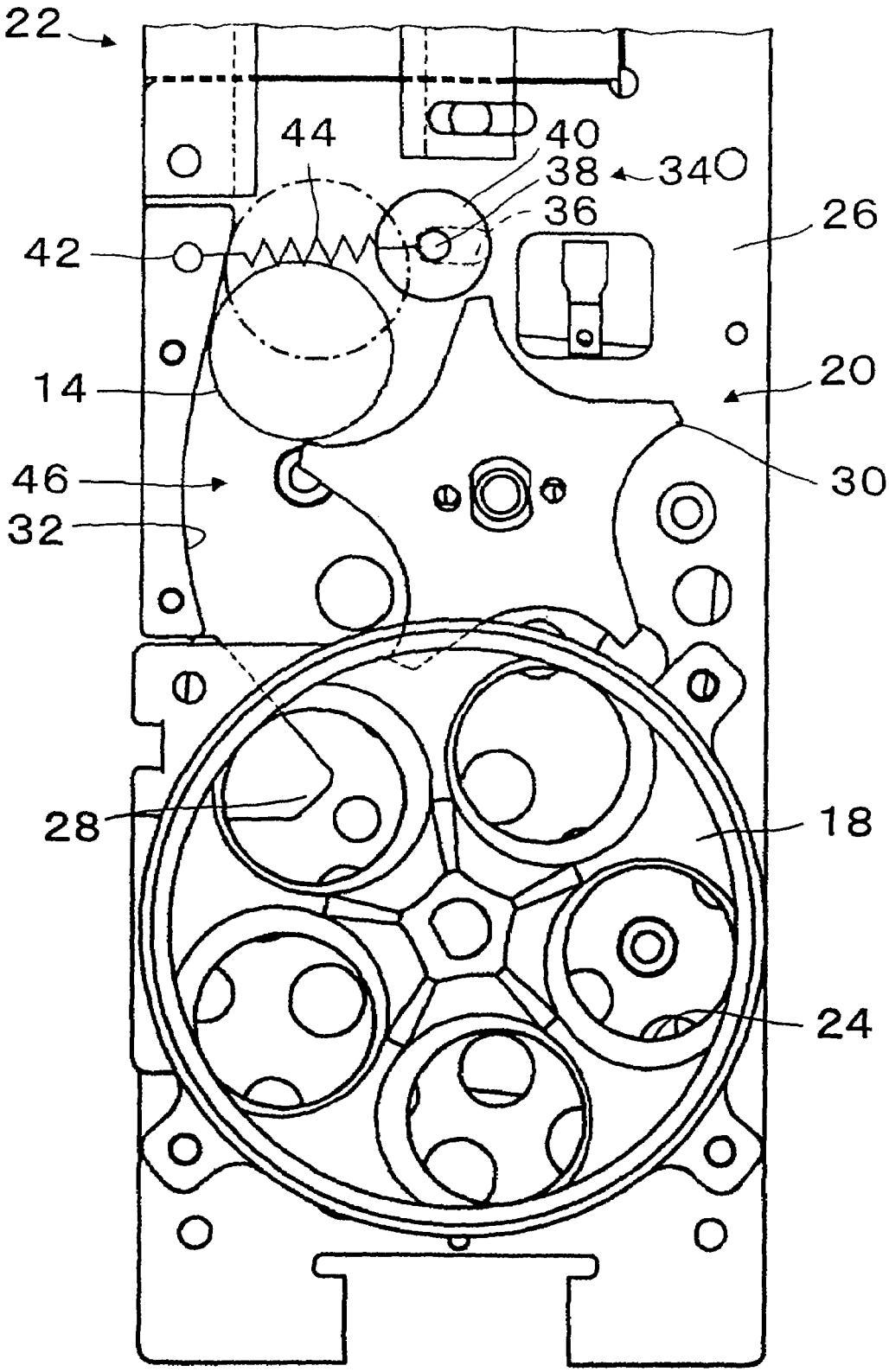
Fig.9 PRIOR ART
FIG. 9 is a schematic view of a prior art coin selector.
Figure 10:
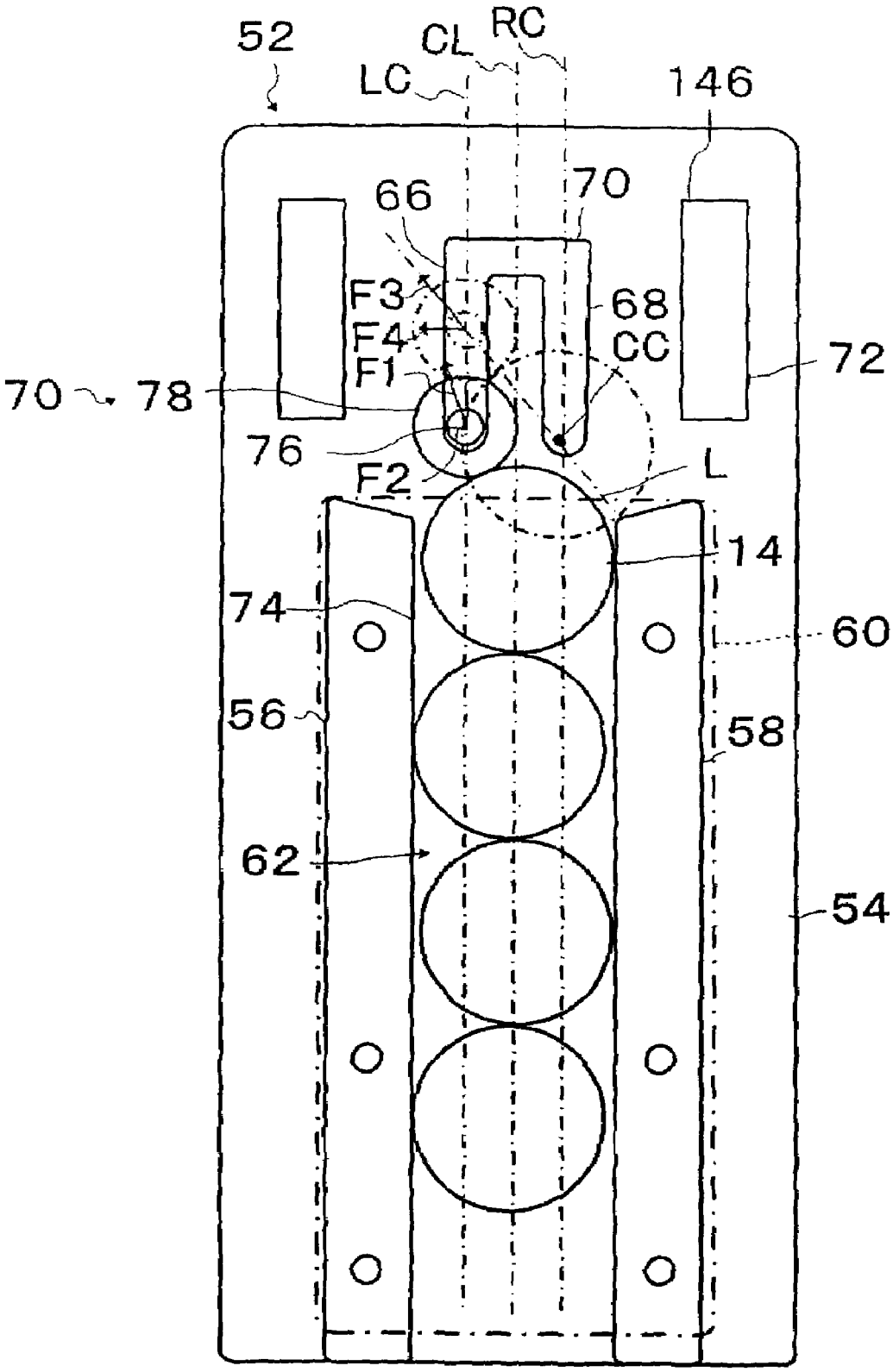
Fig. 10 PRIOR ART
FIG. 10 is an explanatory view of a prior art dispensing apparatus.

Next, as an example where the position of spacer 58 is adjusted for a small coin 14 is explained by referring to FIG. 7. When a small coin 14 has contact with the dispensing body 108, the contacting point P4 is located at the side of center CC of coin 14. Therefore, the extending quantity both of the first elastic body 136 and the second elastic body 142 is smaller. In other words, the resulting urging force applied to coin 14 is smaller, and the change of the urging force is smaller. Accordingly, the permanent deformation is prevented, because the coin is dispensed with a smaller elastic force.

In other words, in the case where roller 118 is located on first right centerline RC 1 which is located between guiding edge 117 of spacer 58 and centerline CL to the minimum diameter (the dotted line shown in FIG. 7) compared to another case where roller 118 is located on the second right centerline RC2 which is located between guiding edge 117 of spacer 58 and centerline CL to the maximum diameter (the solid line shown in FIG. 7), the position of dispensing body 108 is located near the guiding passageway 62 in the latter case. Therefore, the elastic force is made smaller and the change of the elastic force is smaller. Accordingly, the impact force where bearing section 120 runs into stopper 115 is smaller. As a result, permanent deformation is prevented and detecting mistake of coin 14 can be prevented.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A coin dispensing apparatus comprising:

a coin let off unit (10) to dispense coins one by one to a guiding passageway (62) by a rotating disk (18), the let-off coins are guided by the guiding passageway (62); and a dispensing body (108) located only on one sided of a center-line (CL) of said guiding passageway (62) adjacent a coin outlet (63), the dispensing body (108) is urged towards said guiding passageway by an elastic body (136, 142), and dispenses said coins one by one said dispensing body (108) is movable from a first position to a second position along an axis (106,112) which crosses to said center-line at an acute angle and is positioned away from said guiding passageway (62) and away from said center-line.

2. The coin dispensing apparatus claimed in claim 1 wherein said dispensing body is a roller (118) which is rotatable about a shaft (114), said shaft (114) is slidable in a guide member having an elongated hole (102,104) which is located along said axis.

3. The coin dispensing apparatus claimed in claim 2 wherein an end (110) of said elongated hole at the side of said guiding passageway (62) is located on a center-line (LC,RC) which is located between said center-line and a defining member (58,60).

4. The coin dispensing apparatus claimed in claim 2 wherein said roller is made from resin.

5. The coin dispensing apparatus claimed in claim 4 wherein said roller is approximately a cylinder in shape with a body that is narrower at a top and thicker at a base.

6. The coin dispensing apparatus claimed in claim 2, wherein a sensor (150) is located at a coin passageway (166,170) and detects said coins in said passageway.

7. The coin dispensing apparatus claimed in claim 3 wherein said center-line is located at the center of said coin passageway relative to the maximum diameter of a coin, a side edge section (115) of said guiding passageway of said elongated hole is located on said center line (RC).

8. A coin dispensing apparatus comprising:

a rotating disk (18) which dispenses coins (14) one by one to a guiding passageway (62) defined by at least a base (54), said guiding passageway which guides said coins along said base;

a dispensing body (108) located at an outlet (63) on one side of a center-line (CL) of said guiding passageway (62) and urged towards said guiding passageway (62), to dispense said coins one by one;

a first elongated hole (102) which is located on said base and forms an acute angle to said center-line, a second elongated hole (104) which is symmetrical with said first elongated hole on an opposite side of said center-line, said first elongated hole and said second elongated hole are shaped as a channel, a shaft (114) which penetrates in said channel shape holes (146) and supports a roller (118) which is rotatable;

and an elastic body (136, 142) which urges said shaft (114) towards said guiding passageway (62).

9. A coin dispensing assembly for automatically directing coins from a coin exit of a guiding passageway along an exit centerline, comprising:

a coin dispensing unit;

a guide unit operatively moving the coin dispensing unit from a first position to a second position along an axis that forms an acute angle with a centerline that is alignable with the guiding passageway coin exit centerline, the guide unit has a guide length that enables the coin dispensing unit to be initially positioned adjacent the guiding passageway coin exit to contact each exiting coin and subsequently moved by the exiting coin to permit the exiting coin to be released between the guiding passageway coin exit and the coin dispensing unit; and a resilient unit operatively biasing the coin dispensing unit to the initial position while permitting movement along the guide length with a major biasing force exerted toward the exiting coin to reduce wear on the guide unit.

10. The coin dispensing assembly of claim 9 wherein the coin dispensing unit includes a non-metallic roller and a bearing shaft, the roller is rotateably mounted on the bearing shaft.

11. The coin dispensing assembly of claim 10 wherein the resilient unit includes a pair of spring members connected to the bearing shaft.

12. The coin dispensing assembly of claim 11 further including an anchor hook unit for connecting the pair of spring members adjacent the coin guiding passageway to align the spring members at an acute angle with the exit centerline throughout the guide length.

13. The coin dispensing assembly of claim 9 wherein the guide unit includes a U-shaped opening with respective legs of the U-shaped opening inclined toward each other whereby the coin dispensing unit can be operatively positioned in one of the respective legs to enable movement along an axis that forms an acute angle with the centerline.

14. The coin dispensing assembly of claim 13 wherein the resilient unit includes a pair of spring members connected to the coin dispensing unit and an anchor hook unit for connecting the pair of spring members adjacent the coin guiding passageway to align the spring members at an acute angle with the exit centerline throughout the guide length.

* * * * *